US006200005B1

(12) United States Patent
Roberts et al.

(10) Patent No.: US 6,200,005 B1
(45) Date of Patent: Mar. 13, 2001

(54) XENON CERAMIC LAMP WITH INTEGRATED COMPOUND REFLECTORS

(75) Inventors: Roy D. Roberts, Hayward; William F. Hug, Pasadena, both of CA (US)

(73) Assignee: ILC Technology, Inc., Sunnyvale, CA (US)

( * ) Notice: Subject to any disclaimer, the term of this patent is extended or adjusted under 35 U.S.C. 154(b) by 0 days.

(21) Appl. No.: 09/203,721

(22) Filed: Dec. 1, 1998

(51) Int. Cl.[7] ..... F21K 7/00

(52) U.S. Cl. ..... 362/263; 313/113; 362/302; 362/310; 362/343; 362/346

(58) Field of Search ..... 313/113; 362/261, 362/263, 302, 304, 346, 343, 310

(56) References Cited

U.S. PATENT DOCUMENTS

| | | | |
|---|---|---|---|
| 4,305,099 | 12/1981 | True et al. | 358/231 |
| 4,633,128 | 12/1986 | Roberts et al. | 313/113 |
| 4,642,740 | 2/1987 | True | 362/268 |
| 4,755,918 | 7/1988 | Pristash et al. | 362/301 |
| 4,897,771 | 1/1990 | Parker | 362/298 |
| 5,317,484 * | 5/1994 | Davenport et al. | 362/32 |

* cited by examiner

*Primary Examiner*—Stephen Husar
(74) *Attorney, Agent, or Firm*—Thomas E. Schatzel; Law Offices of Thomas E. Schatzel, A Prof. Corp.

(57) ABSTRACT

A xenon ceramic lamp comprising a short-arc lamp with two integral reflectors disposed around the cathode arc ball to collect a wide range of elevation angles of light relative to the center longitudinal axis. The two integral reflectors and the cathode arc ball are within the same sealed volume of the lamp. A first reflector, generally below a common first focus, is a concave elliptical type for projecting light out through a sapphire window to a second focus. A second reflector, generally above the first focus, is a concave spherical type having its focus just offset from the first focus. Therefore, light rays may be emitted at nearly all angles from the cathode arc ball that will be reflected or back reflected by the elliptical and spherical reflectors.

14 Claims, 1 Drawing Sheet

XENON CERAMIC LAMP WITH INTEGRATED COMPOUND REFLECTORS

BACKGROUND OF THE INVENTION

1. Field of the Invention

Figure 1:
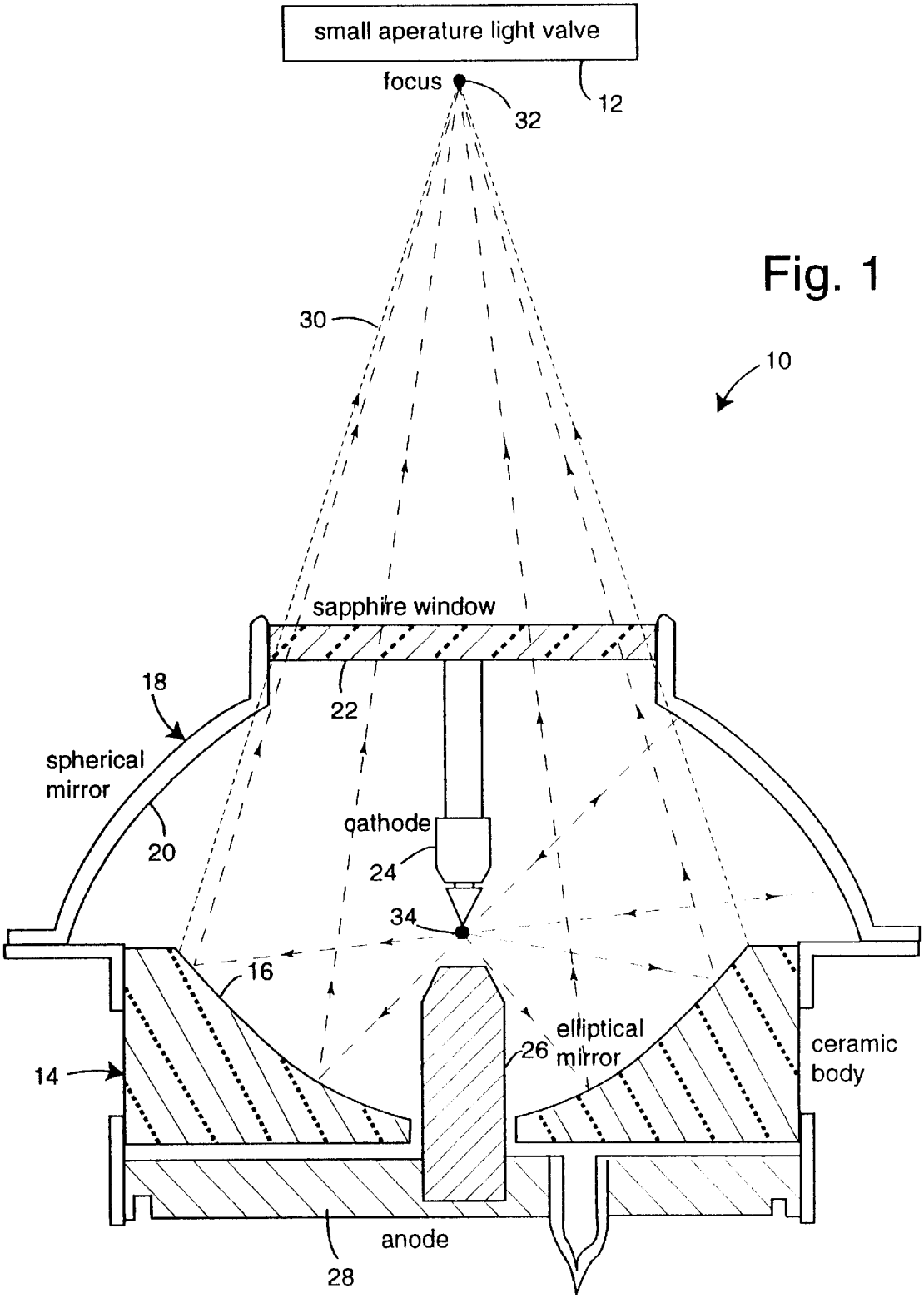

The invention relates generally to xenon short-arc ceramic lamps and specifically to such lamps which incorporate a spherical-elliptical reflector combination in a compound system to improve efficiency.

2. Description of the Prior Art

Short arc lamps provide intense point sources of light that allow light collection in reflectors for applications in medical endoscopes, instrumentation and projection. Also, short arc lamps are used in industrial endoscopes, for example in the inspection of jet engine interiors.

A typical short arc lamp comprises an anode and a cathode positioned along the longitudinal axis of a cylindrical, sealed concave chamber that contains a gas pressurized to several atmospheres. U.S. Pat. No. 4,633,128, issued Dec. 30, 1986, to Roy D. Roberts, the present inventor, and Robert L. Miner, describes such a short arc lamp in which a copper sleeve member is attached to the reflecting wall to conduct heat from the reflecting wall through to the exterior wall and eventually to circulating ambient air.

U.S. Pat. No. 4,305,099, describes a light collection system for projectors, such as light valve projectors, which have a compound reflector associated with an arc lamp. The compound reflector includes an ellipsoidal reflector positioned to collect a portion of the light from the arc lamp and reflect a direct image of the light in a beam to an image forming plane of the projector and a spherical reflector positioned to collect another portion of the light from the arc lamp and reflect it back through the gap of the arc lamp to the ellipsoidal reflector to be reflected as a secondary image of the light from the lamp in the beam. The ellipsoidal and spherical reflectors are formed as full, uninterrupted surfaces of revolution. To provide uniform light distribution, the beam is directed through a pair of spaced lens plates, each having corresponding arrays, in rows and columns, of rectangular lenticules. The adjacent focus of the ellipsoidal reflector is centered in the arc, while the center of curvature of the spherical reflector, in order to avoid transmission loss through the arc, is displaced to a portion of the gap of the lamp which is relatively free of the arc. For maximum light efficiency, the direct image is focused just to one side, and the secondary image is focused just to the other side of the image forming plane. Such patents are all incorporated herein by reference.

Conventional lamps with parabolic collector/reflectors have the advantage of good collection and distribution efficiency when used in conjunction with a lens for focusing. However, such combinations can be too expensive for many applications. Conventional lamps with elliptical collector/reflectors have a different kind of problem. In order to collect a large polar angle of the lamp output, a wide spread of arc magnifications are automatically generated at the second focus. The rays with the smallest angles have the largest magnification. And the rays with the largest angles have the smallest magnification.

The collection efficiency of conventional elliptical collector/reflectors is good, but the distribution efficiency is often poor. In a compound reflector geometry that combines reflector types, the elliptical part is usually a rather shallow dish that provides a small spread of arc magnifications over a select spread of ray angles. But the polar angle collection of such a lamp's output is rather poor from the ellipse.

SUMMARY OF THE PRESENT INVENTION

It is therefore an object of the present invention to provide a xenon ceramic lamp that is more efficient than conventional designs.

Briefly, a ceramic lamp embodiment of the present invention comprises a short arc lamp with two integral reflectors disposed around the cathode arc ball to collect a wide range of elevation angles of light relative to the center longitudinal axis. The two integral reflectors and the cathode arc ball are all within the same sealed volume of the lamp. A first reflector, generally below a common first focus, is a concave elliptical type that projects light out through a sapphire window to a second focus. A second reflector, generally above the first focus, is a concave spherical type that has its focus just offset from the first focus. Therefore, light rays emitted at nearly all angles from the cathode arc ball will be reflected or back reflected by the elliptical and spherical reflectors.

An advantage of the present invention is that a ceramic lamp is provided in which no lamp envelope exists to interfere with the optimum reflection of rays from the spherical back reflector.

Another advantage of the present invention is that a ceramic lamp is provided which is more efficient than the quartz lamps or other types of separate envelopes and compound reflectors.

These and other objects and advantages of the present invention will no doubt become obvious to those of ordinary skill in the art after having read the following detailed description of the preferred embodiment which is illustrated in the drawing figure.

IN THE DRAWINGS

FIG. 1 is a cross-sectional view of xenon short-arc lamp embodiment of the present invention and shows the relative geometries of the concave elliptical reflector and spherical back reflector.

DETAILED DESCRIPTION OF THE PREFERRED EMBODIMENT

FIG. 1 illustrates a xenon short-arc lamp embodiment of the present invention, referred to herein by the general reference numeral 10. A principle purpose and use of the lamp 10 is to illuminate a small-aperture light valve 12, e.g., as are used in projection television receiver systems. The lamp 10 comprises a ceramic body 14 forming a concave elliptical reflector 16, a metal envelope 18 forming a concave spherical back reflector 20, a sapphire window 22, a cathode 24, an anode 26, and a bulk-copper anode base 28. In operation, a light beam 30 is brought to a "second" focus 32. A cathode arc ball 34 is shown for reference. The envelope 18 is preferably made of metal because metal is more readily fashioned and less expensive compared to ceramic materials. A multilayer dichroic cold mirror coating over an absorbing layer for spherical back reflector 20 may be preferable to reduce the infrared output of the lamp 10 and to reduce heat delivered back to the cathode arc ball 34.

The arc can be optimized to extend lifetime over source radiance or brightness. Xenon lamps have more than adequate source brightness to satisfy most video light valve apertures. A compound reflector improves the effective source brightness. So with more than enough brightness, the reflector and overall size can be reduced for the benefit of lifetime. Lower pressures and larger cathode tip radii will thereby reduce cathode tip erosion and improve lifetime.

Conventional xenon short-arc lamps with integral ceramic reflectors are often made of alumina. The ceramic body 14 is preferably constructed of an alumina "toughened" with zirconia. Such zirconia toughened alumina (ZTA) is marketed by Coors Ceramics. A transformation toughened aluminum oxide (GTC-TA) is similarly marketed by Diamonite Products. The advantage of these toughened aluminas is their greater resistance to thermal shock, their tensile strength, and their flexural strength, compared with ordinary alumina used in prior art ceramic lamps. The use of zirconia, toughened alumina significantly improves thermal management, which is one of the biggest design challenges for a short arc lamp. In alternative embodiments of the present invention, aluminum nitride is used in the construction of the ceramic body 14.

In embodiments of the present invention, an integrated spherical back reflector 20 provides for a wider collection angle in elevation from the cathode arc ball 34. The center of curvature of the sphere in the integrated spherical back reflector 20 is preferably coincident at the focus of the ellipse reflector 16. Preferably, any light rays emitted at elevation angles that are not collected by the ellipse reflector 16 will be captured by the spherical back reflector 20 and reflected back through the cathode arc ball 34 to the ellipse reflector 16 and on to the second focus 32. The efficiency of the rays collected by the spherical back reflector 20 is less than the ellipse reflector 16 since they are reflected by the sphere and must also pass through the arc. Light is passed back through the cathode ball of the arc, the absorption can be as high as eighty percent or perhaps more. The center of curvature of the spherical back reflector 20 is not collocated with the focal point of the ellipse reflector 16, but is offset about 0.015 inches. The exact amount of offset depends on the arc conditions of pressure, current, cathode tip radius, and reflector coatings. However, the optimum offset is empirically determinable.

In an alternative embodiment of the present invention, the ceramic body 14 with concave elliptical reflector 16, and metal envelope 18 with concave spherical back reflector 20 can be coaxially placed outside a sealed gas tube housing just the anode-cathode combination. In such a case, the sapphire window 22 becomes unnecessary.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A gas-filled arc lamp, comprising:

an integral compound reflector system coaxially disposed around a short-arc cathode-anode electrode pair and all included in a shared gas volume;

an elliptical reflector included in the integral compound reflector system having a concave surface directed at a first focal point in a plasma space between said cathode-anode electrode pair;

a spherical reflector included in the integral compound reflector system and having a concave surface with a foci proximate to said plasma space between said cathode-anode electrode pair;

a small aperture light valve externally disposed said shared gas volume near a second focal point of the integral compound reflector system.

2. The lamp of claim 1, wherein:

the elliptical reflector is constructed on a ceramic body; and the spherical reflector is disposed on a metallic shell.

3. The lamp of claim 1, wherein:

the spherical reflector is disposed on a metallic shell comprising a dichroic coating providing a cold mirror and absorption layer combination for reducing the intensity of infrared light reflected to said plasma space.

4. The lamp of claim 1, wherein:

the elliptical reflector is constructed on a ceramic body comprising zirconia toughened alumina (ZTA).

5. The lamp of claim 1, wherein:

the elliptical reflector is constructed on a ceramic body comprising transformation toughened aluminum oxide (GTC-TA).

6. The lamp of claim 1, wherein:

the elliptical reflector is constructed on a ceramic body comprising aluminum nitride.

7. The lamp of claim 1, wherein:

the integral compound reflector system including means for providing for a second focus at an external point for the operation of a small-aperture light valve.

8. A gas-filled arc lamp, comprising:

an integral compound reflector system coaxially disposed around a short-arc cathode-anode electrode pair in a gas volume with means for providing for a second focus at an external point for the operation of a small-aperture light valve;

an elliptical reflector constructed on a ceramic body in the integral compound reflector system and having a concave surface directed at a first focal point in a plasma space between said cathode-anode electrode pair;

a spherical reflector disposed on a metallic shell in the integral compound reflector system and having a concave surface with a foci proximate to said plasma space between said cathode-anode electrode pair; and a dichroic coating deposited on said spherical reflector for providing for a cold mirror and absorption layer combination for reducing the intensity of infrared light reflected to said plasma space;

wherein, said elliptical reflector is constructed on a ceramic body comprising at least one of zirconia toughened alumina (ZTA), transformation toughened aluminum oxide (GTC-TA), and aluminum nitride.

9. A gas-filled arc lamp, comprising:

an integral compound reflector system coaxially disposed around a short-arc cathode-anode electrode pair in a gas volume;

an elliptical reflector included in the integral compound reflector system having a concave surface directed at a first focal point in a plasma space between said cathode-anode electrode pair; and a spherical reflector included in the integral compound reflector system and having a concave surface with a foci proximate to said plasma space between said cathode-anode electrode pair;

wherein, the elliptical reflector is constructed on a ceramic body; and wherein, the spherical reflector is disposed on a metallic shell.

10. A gas-filled arc lamp, comprising:

an integral compound reflector system coaxially disposed around a short-arc cathode-anode electrode pair in a gas volume;

an elliptical reflector included in the integral compound reflector system having a concave surface directed at a first focal point in a plasma space between said cathode-anode electrode pair; and a spherical reflector included in the integral compound reflector system and having a concave surface with a foci proximate to said plasma space between said cathode-anode electrode pair;

wherein, the spherical reflector is disposed on a metallic shell comprising a dichroic coating providing a cold mirror and absorption layer combination for reducing the intensity of infrared light reflected to said plasma space.

11. A gas-filled arc lamp, comprising:

an integral compound reflector system coaxially disposed around a short-arc cathode-anode electrode pair in a gas volume;

an elliptical reflector included in the integral compound reflector system having a concave surface directed at a first focal point in a plasma space between said cathode-anode electrode pair; and a spherical reflector included in the integral compound reflector system and having a concave surface with a foci proximate to said plasma space between said cathode-anode electrode pair;

wherein, the elliptical reflector is constructed on a ceramic body comprising zirconia toughened alumina (ZTA).

12. A gas-filled arc lamp, comprising:

an integral compound reflector system coaxially disposed around a short-arc cathode-anode electrode pair in a gas volume;

an elliptical reflector included in the integral compound reflector system having a concave surface directed at a first focal point in a plasma space between said cathode-anode electrode pair; and a spherical reflector included in the integral compound reflector system and having a concave surface with a foci proximate to said plasma space between said cathode-anode electrode pair;

wherein, the elliptical reflector is constructed on a ceramic body comprising transformation toughened aluminum oxide (GTC-TA).

13. A gas-filled arc lamp, comprising:

an integral compound reflector system coaxially disposed around a short-arc cathode-anode electrode pair in a gas volume;

an elliptical reflector included in the integral compound reflector system having a concave surface directed at a first focal point in a plasma space between said cathode-anode electrode pair; and a spherical reflector included in the integral compound reflector system and having a concave surface with a foci proximate to said plasma space between said cathode-anode electrode pair;

wherein, the elliptical reflector is constructed on a ceramic body comprising aluminum nitride.

14. A gas-filled arc lamp, comprising:

an integral compound reflector system coaxially disposed around a short-arc cathode-anode electrode pair in a gas volume;

an elliptical reflector included in the integral compound reflector system having a concave surface directed at a first focal point in a plasma space between said cathode-anode electrode pair; and a spherical reflector included in the integral compound reflector system and having a concave surface with a foci proximate to said plasma space between said cathode-anode electrode pair;

wherein, the integral compound reflector system including means for providing for a second focus at an external point for the operation of a small-aperture light valve.

* * * * *